US011661794B2

(12) United States Patent
Beaulieu

(10) Patent No.: US 11,661,794 B2
(45) Date of Patent: May 30, 2023

(54) SCAFFOLD ACCESSORIES

(71) Applicant: Henri-Pascal Beaulieu, Terrebonne (CA)

(72) Inventor: Henri-Pascal Beaulieu, Terrebonne (CA)

( * ) Notice: Subject to any disclaimer, the term of this patent is extended or adjusted under 35 U.S.C. 154(b) by 0 days.

(21) Appl. No.: 15/451,487

(22) Filed: Mar. 7, 2017

(65) Prior Publication Data

US 2017/0260810 A1 Sep. 14, 2017

(51) Int. Cl.

| | |
|---|---|
| ***E04G 5/00*** | (2006.01) |
| ***E06C 1/36*** | (2006.01) |
| ***E04G 5/06*** | (2006.01) |
| ***E04G 1/28*** | (2006.01) |
| ***E04G 1/15*** | (2006.01) |

(52) U.S. Cl.

CPC ..... *E06C 1/36* (2013.01); *E04G 1/15* (2013.01); *E04G 1/28* (2013.01); *E04G 5/00* (2013.01); *E04G 5/003* (2013.01); *E04G 5/061* (2013.01)

(58) Field of Classification Search

CPC ..... E06C 7/14; E06C 1/36; E04G 5/00; E04G 5/003; E04G 5/004; E04G 1/15; E04G 1/28; E04G 5/061

USPC ..... 248/210, 211, 238

See application file for complete search history.

(56) References Cited

U.S. PATENT DOCUMENTS

| | | | | | |
|---|---|---|---|---|---|
| 956,835 | A | * | 5/1910 | Taulman | B60R 7/10 224/401 |
| 1,551,243 | A | * | 8/1925 | Dick | E06C 7/14 182/121 |
| 2,226,228 | A | | 12/1940 | Kunde | |
| 2,645,443 | A | | 7/1953 | Pelletier | |
| 2,674,427 | A | * | 4/1954 | Woodward | E06C 7/14 248/152 |
| 2,675,982 | A | * | 4/1954 | Budy | E06C 7/14 182/195 |
| 2,703,215 | A | * | 3/1955 | Weiss | E06C 7/14 248/210 |
| 2,837,306 | A | | 6/1958 | Elm | |
| 2,855,170 | A | | 10/1958 | Spinello | |
| 3,029,054 | A | * | 4/1962 | Mott | E06C 7/14 248/211 |
| 3,154,282 | A | * | 10/1964 | Monson | E06C 7/14 248/211 |
| 3,278,148 | A | * | 10/1966 | Denaro | B44D 3/14 211/73 |
| 3,420,486 | A | * | 1/1969 | Baker | E06C 7/14 248/210 |
| 4,560,127 | A | * | 12/1985 | Ippolito | E06C 7/14 182/106 |
| 4,979,710 | A | | 12/1990 | Baldwin | |
| 4,991,808 | A | * | 2/1991 | LaChance | E06C 7/14 182/106 |
| 5,079,795 | A | * | 1/1992 | Schmid | B44D 3/126 15/257.06 |
| 5,099,952 | A | * | 3/1992 | Farrell | E06C 7/16 182/122 |
| 5,342,008 | A | * | 8/1994 | Kay | E06C 7/14 182/129 |

(Continued)

*Primary Examiner* — Daniel P Cahn

(74) *Attorney, Agent, or Firm* — Christopher Pilling

(57) ABSTRACT

A set of accessories for use in combination with a scaffold is comprised of at least one pair of support hooks, at least one stirrup member for facilitating stepping up or down from the scaffold, at least one material holder.

9 Claims, 4 Drawing Sheets

(56) References Cited

U.S. PATENT DOCUMENTS

| | | | | |
|---|---|---|---|---|
| 6,009,976 | A * | 1/2000 | Gorney | E06C 7/14 182/129 |
| 6,105,911 | A * | 8/2000 | Olexson | E06C 7/14 248/210 |
| 8,602,365 | B2 * | 12/2013 | Neace | H02G 3/32 248/215 |
| 8,925,683 | B1 * | 1/2015 | Gunsaullus | E06C 1/38 182/129 |
| 9,249,003 | B2 * | 2/2016 | Reeves | B66F 13/00 |
| 10,119,332 | B1 * | 11/2018 | Schellens | E06C 7/165 |
| 2009/0147527 | A1 * | 6/2009 | O'Connor | E06C 7/14 362/396 |
| 2014/0319297 | A1 * | 10/2014 | Keschock | B66F 11/042 248/215 |

* cited by examiner

SCAFFOLD ACCESSORIES

CROSS-REFERENCE TO RELATED APPLICATIONS

The present application claims priority to UK request for grant of a patent GB1604080.0, filed on Mar. 9, 2016 entitled "Scaffolding accessories", the disclosure of which is hereby incorporated in its entirety at least by reference.

FIELD OF THE INVENTION

The present invention relates generally to scaffolds, but more particularly to scaffold accessories.

BACKGROUND OF THE INVENTION

Scaffolds are really useful in constructions and depending upon their intended purpose, different types of scaffoldings have been developed over the years. One such type of scaffold is for use inside buildings for work on ceilings. They are small, foldable, and have lockable wheels so as to be moved around quickly and easily. This type of scaffold is used for installing suspended ceilings. This type of installation requires very little tools but a lot of material. Unfortunately, this type of scaffold is not optimized for carrying material and workers need to constantly go up and down to fetch new material or else they are encumbered by material that they try to fit onto the scaffold. There is a need for a wider variety of accessories to help supports tools and supplies.

SUMMARY OF THE INVENTION

In view of the foregoing disadvantages inherent in the known devices now present in the prior art, the present invention, which will be described subsequently in greater detail, is to provide objects and advantages which are:

To provide for a set of accessories for a scaffold optimized for installing suspended ceilings.

In order to do so, the invention comprises a set of accessories for use with a scaffold which is further comprised of support hooks, at least one stirrup member for facilitating stepping up or down from the scaffold, and a material holder.

In a preferred embodiment, the support hooks are comprised of a "U" shaped support section which extends integrally from an attachment member, which has a generally triangular web member which connects the "U" shaped support section to a wraparound hooking member, which is configured and sized to partially wrap around a horizontal pipe, which forms part of the scaffold. A stub member extending perpendicularly from the "U" shaped support section so as to, along with the attachment member, prevent pendulum swing from the "U" shaped support section.

In a preferred embodiment, the stirrup member has the attachment member, the wraparound hooking member, and a step member extending perpendicularly from the wraparound hooking member. The step member is comprised of a horizontal step on section and a diagonal support section to support the step on section. The perpendicular configuration of the step member, with the attachment member, creates a fold member which prevents pendulum swing from the stirrup member.

In a preferred embodiment, the material holder has a pair of wraparound hooking members wherein a first wraparound hooking member is permanently connected to a back member, while a second wraparound hooking member is slidingly adjustable vertically along the back member by sliding up or down a slit made into the back member. The holder is also comprised of a base portion, and a cincture member.

In yet another preferred embodiment, the support hook comes in pairs configured as mirror images so as to fit on each extremity of the scaffold.

In yet another preferred embodiment, the wraparound hooking member has an opening which allows for passing the head of a bolt.

In yet another preferred embodiment, the support hooks are configured and sized for holding ceiling tiles.

In yet another preferred embodiment, the stirrup member comes in pairs configured as mirror images so as to fit on each extremity of the scaffold.

In yet another preferred embodiment, the stirrup member has an opening which allows for passing the head of a bolt.

In yet another preferred embodiment, the stirrup member points towards the inside of the scaffold.

In yet another preferred embodiment, the material holder is configured and sized for holding long and narrow pieces of material used for suspended ceilings.

In yet another preferred embodiment, once adjusted for height, the wraparound hooking members are set in place on the scaffold horizontal pipes by tightening mechanical fasteners.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION

A set of accessories for use with a scaffold (10) is comprised of support hooks (12), a stirrup member (14) for facilitating stepping up or down from the scaffold (10). A material holder (16).

Figure 1:
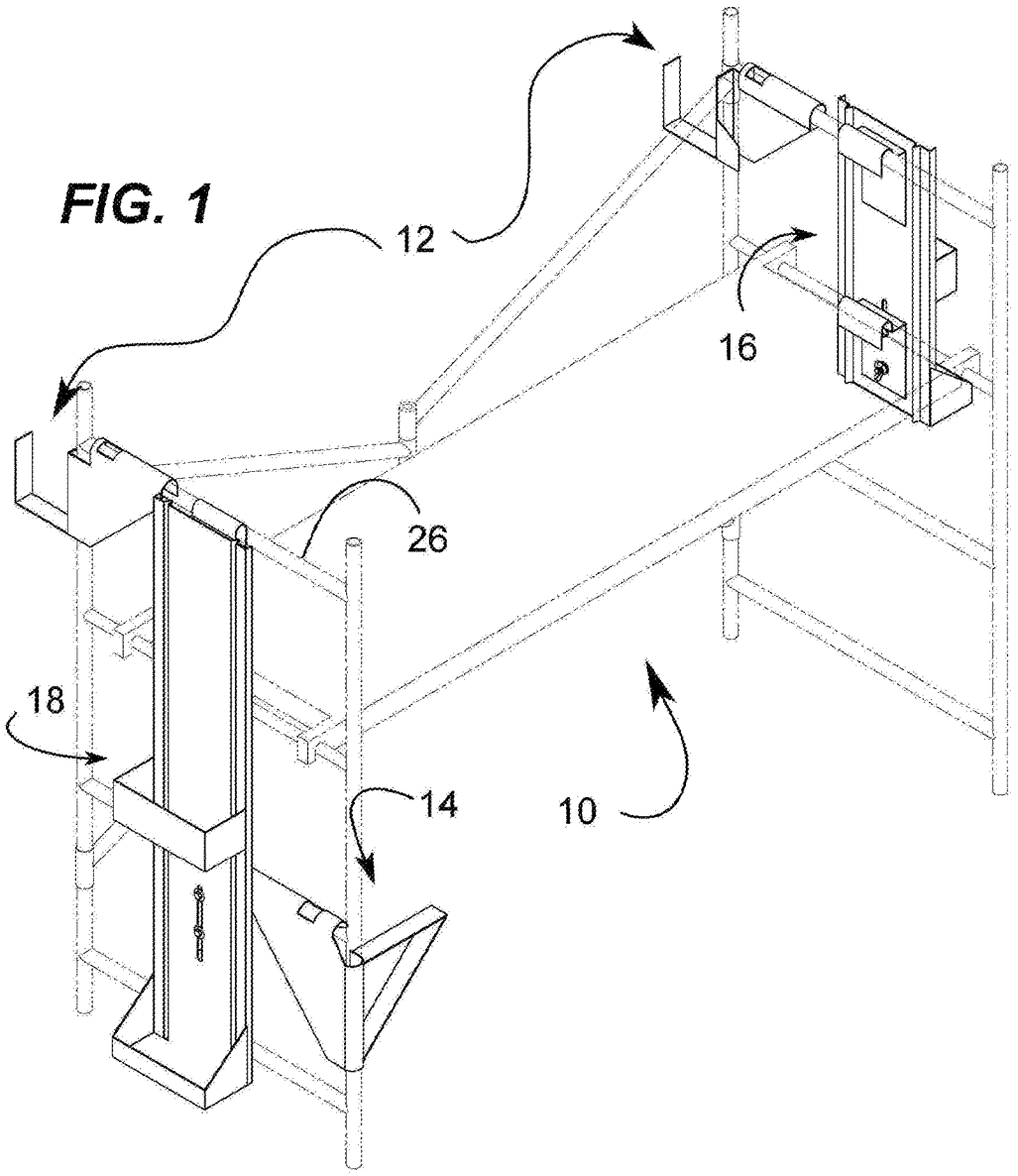
FIG. 1 Isometric view of the invention in context.
Figure 2:
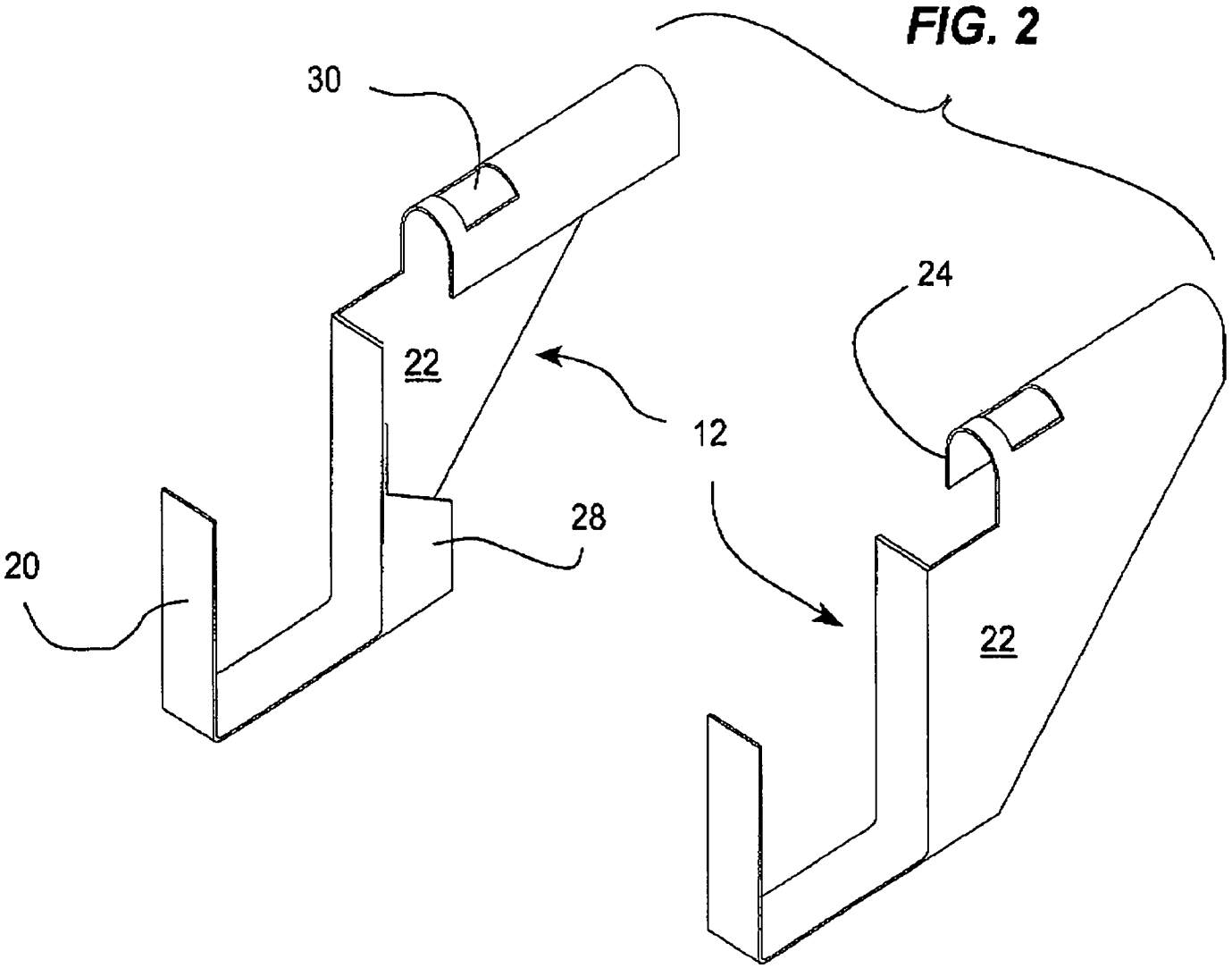
FIG. 2 Isometric view of the hooking members
FIG. 3 Isometric view of the stirrup member.

The support hooks (12) are comprised of a "U" shaped support section (20) which extends integrally from an attachment member (22) which has a generally triangular web member which connects the "U" shaped support section (20) to a wraparound hooking member (24) which is configured and sized to partially wrap around a horizontal pipe (26) which forms part of the scaffold (10). A stub member (28) extends perpendicularly from the "U" shaped support section (20) so as to, along with the attachment member (22), prevent any pendulum swing from the "U" shaped support section (20). To best fit on each extremity of the scaffold (10) there are two configurations of support hooks (12), which are in fact mirror images, relative to each other as can be seen in FIG. 2. The wraparound hooking member (24) has an opening (30) which allows for passing the head of a bolt (not shown) when some models of scaffolds have their horizontal pipe (26) bolted instead of welded.

Figure 3:
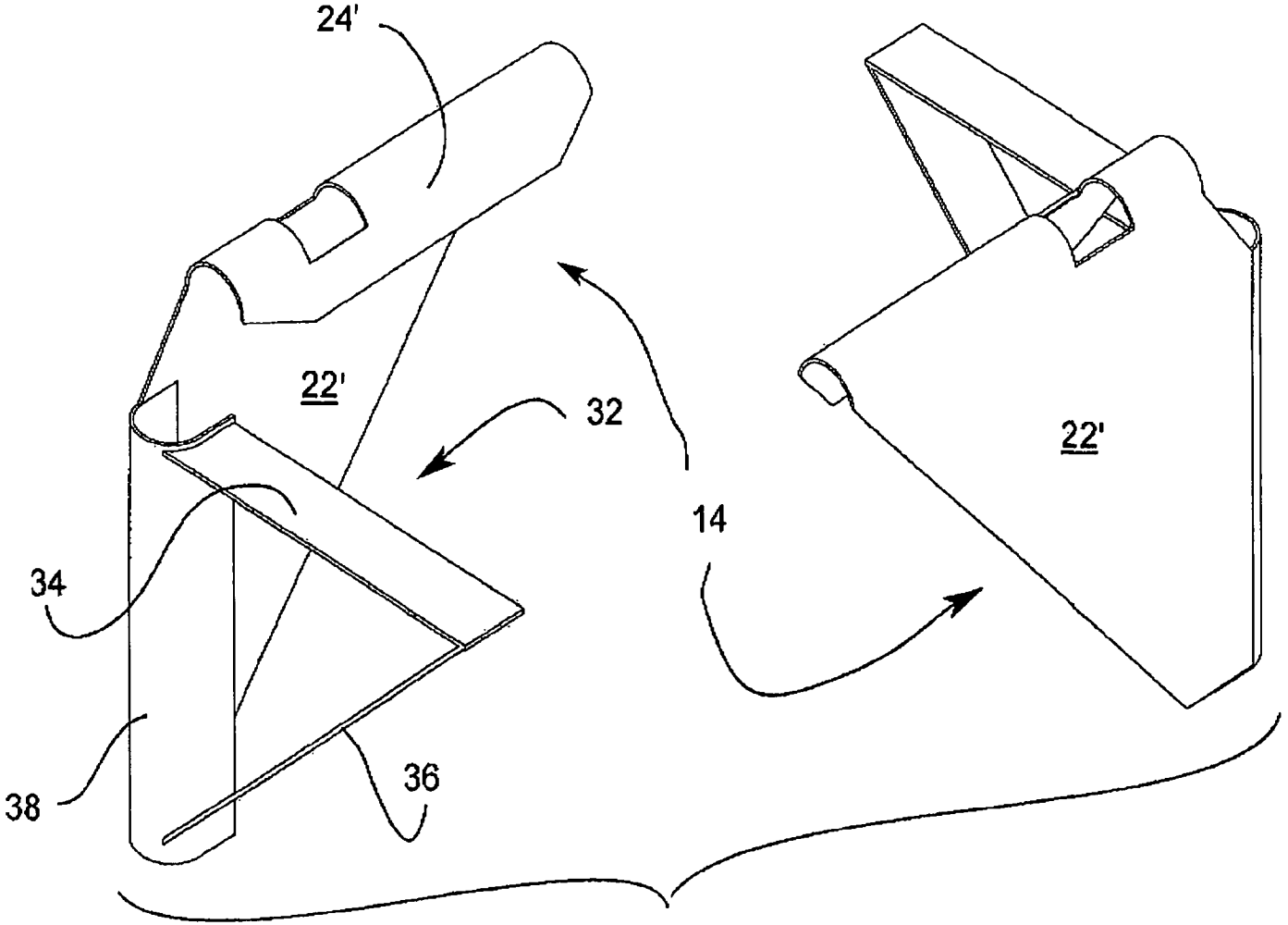
Figures 4A, 4B:
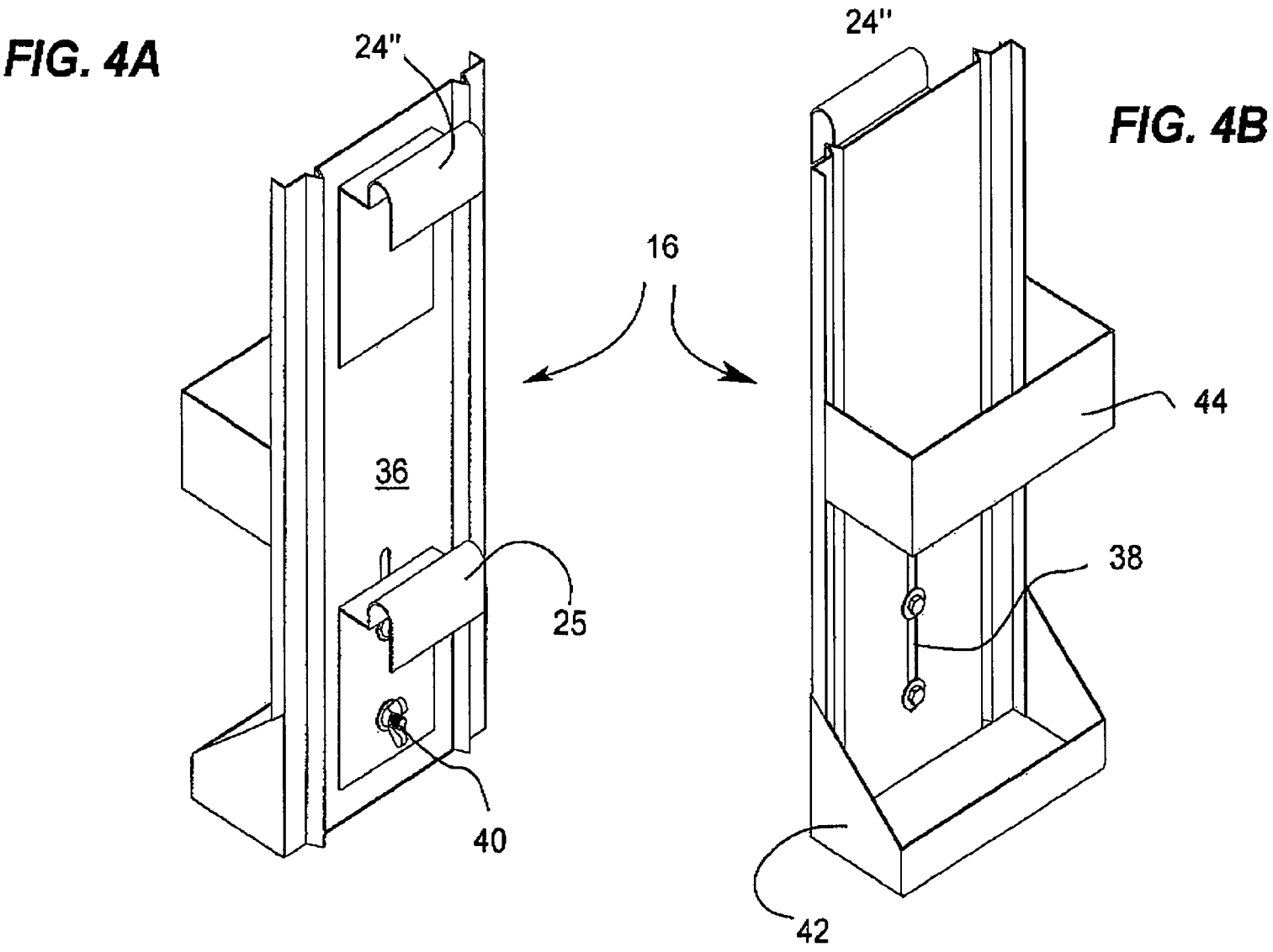
FIGS. 4A-B Isometric and reverse angle view of the material holder.

The stirrup member (14) is very similar in structure to the support hook (12) as it also comes in mirror image configurations, as seen in FIG. 3. It has a stirrup attachment member (24') identical in function to the previously introduced attachment member (22) of the support hook (12) which is now referred to as stirrup attachment member (22') and a stirrup wraparound hooking member (24') identical in form and function to the previously introduced wraparound hooking member (24). The stirrup member (14) has a step member (32) that extends perpendicularly from the stirrup wraparound hooking member (24'). The step member (32) is comprised of a horizontal step on section (34) and a diagonal support section (36) to support the step on section (34). No new matter.

The perpendicular configuration of the step member (32) with the stirrup attachment member (22') creates a fold member (38) which prevents pendulum swing from the stirrup member (14). Also, the stirrup member (14) points towards the inside of the scaffold (10) to prevent putting the scaffold from being put off balance from an otherwise exterior lever effect.

The material holder (16) can be used for holding long and narrow pieces such as steel runners used in the making of suspended ceilings while the support hooks (12) are used for holding the tiles.

The material holder (16) has a material holder wraparound hooking members (24") as well as a secondary material holder wraparound hooking member (25) which is slidingly adjustable vertically by sliding up or down a slit (38) made into the back member (36). Once adjusted for height, it is set in place by tightening mechanical fasteners (40), and both the material holder wraparound hooking member (24") and the secondary material holder wraparound hooking member (25) can be releasably hooked onto horizontal pipes (26). The holder (16) has a base portion (42) and a cincture member (44).

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A set of accessories for use in combination with a scaffold is comprised of one pair of support hooks, at least one stirrup member for facilitating climbing up or down from the scaffold, and at least one material holder; the one pair of support hooks is comprised of a "U" shaped support section which extends integrally from a support hook attachment member which is a generally triangular web member which connects the "U" shaped support section to a support hook wraparound hooking member, which is configured and sized to partially wrap around a horizontal pipe which forms part of the scaffold; a stub member extending perpendicularly from the "U" shaped support section so as to, along with the support hook attachment member, prevent pendulum swing from the "U" shaped support section; the at least one stirrup member has a stirrup member attachment member, a stirrup wraparound hooking member, and a step member extending perpendicularly from the stirrup wraparound hooking member; the step member is comprised of a horizontal step on section and a diagonal support section to support the step on section; a perpendicular configuration of the step member with the stirrup attachment member creates a fold member which is configured to prevent pendulum swing of the stirrup member when attached to the scaffold.

2. The set of accessories for use with the scaffold of claim 1 wherein a support hook wraparound hooking member, the stirrup wrap around hooking member, and the material holder wraparound hooking member all have an opening which allows for passing a head of a bolt.

3. The set of accessories for use with the scaffold of claim 1 wherein the pair of support hooks is configured and sized for holding ceiling tiles.

4. The set of accessories for use with the scaffold of claim 1 wherein the at least one stirrup member comes in a pair configured as a mirror image relative to each other so as to fit on each extremity two extremities of the scaffold.

5. The set of accessories for use with the scaffold of claim 1 wherein the at least one stirrup member has an opening which allows for passing a head of a bolt.

6. The set of accessories for use with the scaffold of claim 1 wherein the stirrup member points towards an inside of the scaffold.

7. The set of accessories for use with the scaffold of claim 1 wherein the material holder is configured and sized for holding pieces of material used for suspended ceilings.

8. The set of accessories for use with the scaffold of claim 1 wherein the stirrup member points towards an inside of the scaffold.

9. The set of accessories for use with the scaffold of claim 1 wherein the material holder is configured and sized for holding long and narrow pieces of material used for suspended ceilings.

* * * * *